US006962439B2

(12) United States Patent
Taheri

(10) Patent No.: US 6,962,439 B2
(45) Date of Patent: Nov. 8, 2005

(54) LEAK RESISTANT TAMPER EVIDENT RECLOSABLE PLASTIC BAG

(75) Inventor: Nossi Taheri, Atlanta, GA (US)

(73) Assignee: The BagCo, Inc., Atlanta, GA (US)

( * ) Notice: Subject to any disclaimer, the term of this patent is extended or adjusted under 35 U.S.C. 154(b) by 0 days.

(21) Appl. No.: 10/093,565

(22) Filed: Mar. 8, 2002

(65) Prior Publication Data

US 2003/0169947 A1 Sep. 11, 2003

(51) Int. Cl.[7] ..... B65D 33/16
(52) U.S. Cl. ..... 383/61.2; 383/63; 383/204
(58) Field of Search ..... 383/5, 61.1, 61.2, 383/65, 35, 43, 204, 7, 6, 63

(56) References Cited

U.S. PATENT DOCUMENTS 3,172,443 A * 3/1965 Ausnit ..... 383/203
3,226,787 A * 1/1966 Ausnit ..... 24/586.1
3,338,284 A * 8/1967 Ausnit ..... 383/65
3,684,156 A * 8/1972 Fettinger et al. ..... 229/240
RE28,969 E * 9/1976 Naito ..... 383/65
4,589,145 A * 5/1986 Van Erden et al. ..... 383/5
4,654,878 A * 3/1987 Lems ..... 383/37
4,966,470 A * 10/1990 Thompson et al. ..... 383/210.1
4,998,646 A * 3/1991 Sherman ..... 222/107
5,033,868 A * 7/1991 Peppiatt ..... 383/29
5,070,584 A * 12/1991 Dais et al. ..... 24/585.12
5,121,995 A * 6/1992 Newman et al. ..... 383/29
5,211,481 A * 5/1993 Tilman ..... 383/63
5,385,251 A 1/1995 Dunn
5,664,303 A * 9/1997 Johnson ..... 24/585.12
5,749,658 A * 5/1998 Kettner ..... 383/204
5,955,160 A 9/1999 Tanaka et al.
6,020,013 A * 2/2000 Kozma ..... 426/393
6,059,457 A 5/2000 Shrehe et al.
6,149,302 A * 11/2000 Taheri ..... 383/5
6,167,597 B1 * 1/2001 Malin ..... 24/585.1
6,196,716 B1 3/2001 Geyer
6,227,359 B1 * 5/2001 Truluck ..... 206/207
6,273,607 B1 * 8/2001 Buchman ..... 383/5
6,273,609 B1 8/2001 Johnson
6,325,543 B1 12/2001 Ausnit
6,345,911 B1 * 2/2002 Young et al. ..... 383/6
6,360,513 B1 * 3/2002 Strand et al. ..... 53/412
6,361,209 B1 * 3/2002 LaRue et al. ..... 383/10
6,517,242 B1 * 2/2003 Buchman ..... 383/5
2003/0059128 A1 * 3/2003 Vangedal-Nielsen ..... 383/4

* cited by examiner

*Primary Examiner*—Joseph C. Merek
(74) *Attorney, Agent, or Firm*—Weatherly Kerven LLC; Mitchell G. Weatherly; David S. Kerven

(57) ABSTRACT

A reclosable plastic bag includes two panels sealed to form a container having a bottom and an openable top. The plastic bag further includes lips that are adjacent to the openable top and which are initially joined to one another by a removable element. The removable element when attached indicates that the bag has not yet been used. When the removable element is no longer attached this indicates that the bag may have been used (contaminated). The reclosable plastic bag also includes a closure element for sealing and unsealing the openable top of the bag.

5 Claims, 3 Drawing Sheets

LEAK RESISTANT TAMPER EVIDENT RECLOSABLE PLASTIC BAG

TECHNICAL FIELD

The present invention relates generally to containers and more specifically to reclosable plastic bags.

BACKGROUND OF THE INVENTION

Reclosable plastic bags are used for many purposes, including transporting and storing food products and other materials. Reclosable bags are often preferred over other available bags because of numerous advantages, including that they are easy to close and reopen for access without compromise of integrity when closed.

Typically, such bags are reclosable using a zip-action, locking reclosable closure. Unfortunately, when using such a bag for a first time, there is currently no way of knowing if the bag is sanitary, has been used, tampered with or otherwise contaminated. This is particularly important if the contents to be stored in the bag are perishable or easily contaminated. Exemplary of such is breast milk.

Likewise, currently available bags are typically difficult to fill (E.G., with a liquid substance) without obstruction from the lips and/or spilling along the sides of the bag. At least one reason it is difficult to fill currently available bags is that the edges are typically heat-sealed along their entire length from the bottom of the bag to the top of the bag. These heat-sealed edges typically make it somewhat difficult to pull the lips apart, as well as impede the ability of the bag to remain open during filling.

Yet another disadvantage of using currently available bags to store liquids is that the zipper may not remain sealed. This is particularly true when, for instance, the bag lies on its side—the bag thus situated is more likely to seep some of the liquid contents.

The present invention avoids these and other difficulties by providing a tamper evident reclosable bag that ensures that the bag is being used for the first time. The present invention further provides a bag that is easier to open, easier to fill, seals better, and has less leakage than currently available bags.

SUMMARY OF THE INVENTION

Briefly described, in a first preferred form the present invention comprises a reclosable plastic bag. The reclosable plastic bag of the present invention has many uses; one exemplary use of the bag is for storing liquids, such as breast milk. The bag of the present invention includes two panels sealed to form a container having a bottom and an openable top. The plastic bag further includes lips that are adjacent to the openable top and which are initially joined to one another by a removable element. The removable element when attached indicates that the bag has not yet been used. When the removable element is no longer attached this indicates that the bag may have been used (and potentially contaminated). The reclosable plastic bag also includes a closure element for sealing and unsealing the openable top of the bag.

Optionally, the lips are unattached to one another along a significant portion of their respective side edges, but are attached to one another for at least a little length along the side edges immediately above the closure element. Optionally, this can be accomplished by initially sealing the lips to one another using a heat seal along the side edges and then notching the side edges of the lips to remove at least part of the heat seal.

Also optionally, the lips can be scored or otherwise pre-formed for facilitating removal of the removable element. Also optionally, the lips can include indicia (markings) to indicate the location of the removable element.

Furthermore, the reclosable plastic bag of the present invention can include two closure elements to provide a more leak-proof sealing of the bag. Most preferably, the two zippers each include an asymmetrical barb, which barbs are both oriented in a manner to facilitate opening the bag using the lips but rendering accidental opening of the bag less likely. Preferably, each of the lips is rather tall to facilitate easy opening of the bag. Most preferably, each of the lips is more than one inch in height.

In another preferred form, the present invention comprises a reclosable plastic bag including front and back panels sealed to one another to form a container. The container has a bottom, an openable top and a closure element for sealing and unsealing the openable top. Lips extend from the closure element for facilitating the opening of the closure element. The lips are sealed to one another along their respective side edges immediately above the closure element, but are unattached to one another along a substantial portion of their side edges.

Preferably, the lips are unattached to one another along most of their respective side edges. Optionally, the lips are notched along their respective side edges to remove a heat seam initially formed in the side edges. Optionally, each of the lips is more than one inch in height to facilitate easy opening of the bag.

Preferably, the bag includes two closure elements, one parallel to the other. Preferably, each of these closure elements includes an asymmetrical barb having a long side and a short side, with the long sides of the barbs pointing toward the interior of the bag and away from the lips. Preferably, the bottom of the bag is gusseted to enable the bag to be freestanding.

Optionally, the lips are initially joined to one another by a removable strip, the removable strip when attached indicating that the bag has not been used and when no longer attached indicating that the bag might have been used. Optionally, the lips can be scored or otherwise pre-formed to facilitate easy removal of the removable strip.

Bags according to the present invention have numerous advantages. For example, such a bag is extremely well-suited to containing liquids and aggregate material. Furthermore, it is particularly well-suited to safely storing perishables, including breast milk, for example. Contributing to this utility is the ability to ensure that the interior of the bag has not been contaminated simply by observing that the tamper-evident strip or removable element is still attached to the lips (i.e., the lips are still attached to one another). This is a good indication that the bag has not been opened and thereby indicates that no contamination has been introduced into the interior of the bag. Moreover, the large lips provide more convenient handles for handling the bag and opening the openable top of the bag. The cutouts in the lips provide a ready grip even when the lips are still joined by the removable strip. Furthermore, by eliminating some of the heat seal normally found on typical prior art reclosable plastic bags along the entire length of the side edges of the lips, the lips are more naturally opened, ready to pull part.

Also, by providing some heat seal along the side edges of the lips immediately above the zipper, the integrity of the edge of the zipper is protected as the user pulls on the lips.

In other words, without at least a little heat seal above the zipper (or some other strain relief feature), pulling on the lips would tend to pull the edges of the zipper apart. Furthermore, the use of dual, asymmetrical zippers helps to ensure that the contents of the bag do not leak out. The bottom gusset allows the bag to be freestanding, an important advantage when dealing with liquid contents.

That the invention improves over the prior art and accomplishes the advantages described above will become apparent from the following detailed description of the exemplary embodiments and the appended drawings and claims.

BRIEF DESCRIPTION OF THE DRAWINGS

As used herein, like numerals throughout the various figures represent the same or equivalent features of the present invention.

DETAILED DESCRIPTION OF THE EMBODIMENTS

The present invention is directed to containers and in particular to novel reclosable plastic bags, tamper evident plastic bags, and closure profiles for reclosable bags. The general principles for making reclosable plastic bags are fairly well-known and are typified in numerous prior patents. Various developments in the reclosable plastic bag art, including methods of manufacture and various die assemblies used to manufacture such bags, are disclosed in U.S. Pat. No. 6,217,216 to Taheri (describes methods for forming bags), U.S. Pat. No. 4,755,248 to Geiger et al. (die assemblies), U.S. Pat. Nos. 4,101,355 (using adhesives to join a closure profile to a bag) and 3,338,284 (forming a bag film web using a single extrusion operation) to Ausnit, U.S. Pat. Nos. Re. 28,959, 29,208 and 28,969 to Naito, U.S. Pat. No. Re. 33,674 to Uramoto, and U.S. Pat. No. Re. 26,991 to Luca, (interlocking closure profiles), all of which are hereby incorporated by reference in their entireties for background information. Although these patents disclose numerous fundamental methods for forming reclosable bags and reclosable closure elements, the present improvements are intended to be suitable with any of the known methods. It may be possible to use many fundamental methods, to modify or adapt them, and to incorporate them into the invention disclosed below.

Figure 1:
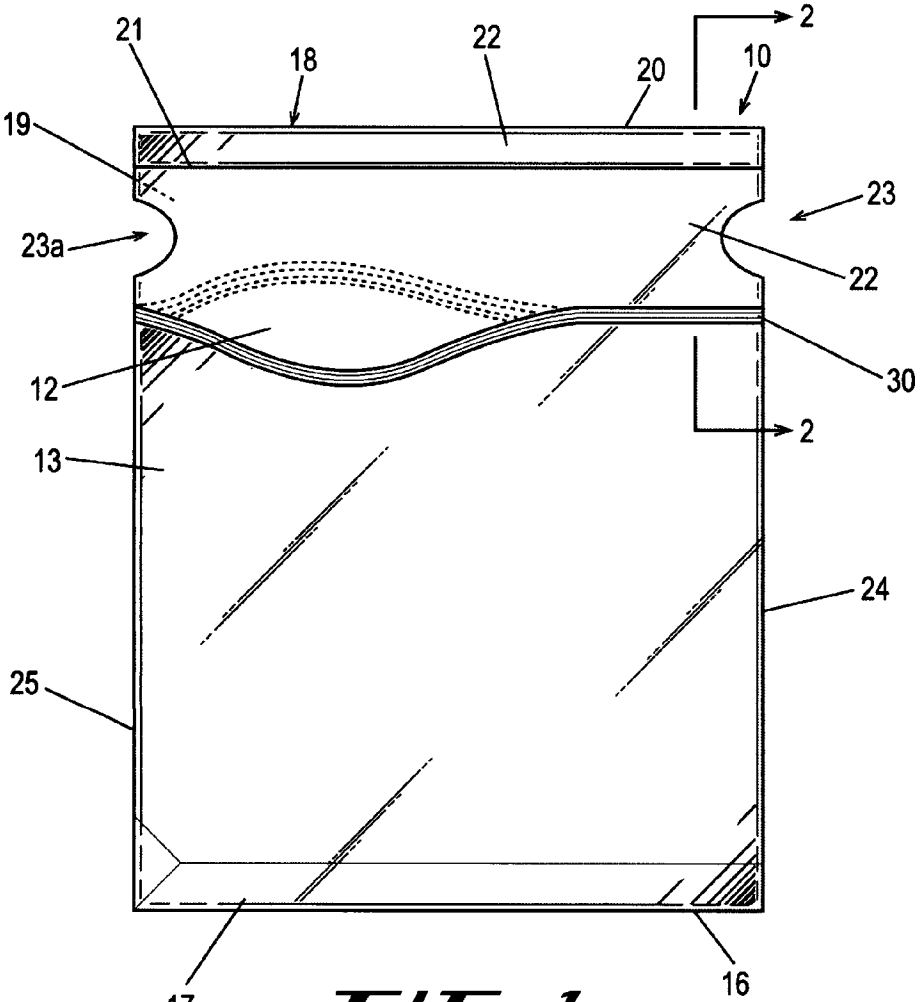
FIG. 1 is a front perspective view of a tamper evident reclosable plastic bag according to one aspect of the present invention.

In a first preferred form the present invention comprises a reclosable bag 10, as shown for instance in FIG. 1, and includes first and second panels 12 and 13. As contemplated herein, bag 10 can contain more than two panels, such as when a third panel is provided to form a document pouch for holding papers or identifying material (not shown).

The bag 10 preferably is fabricated from plastic or other flexible material(s). The bag 10 can be formed from one or more of the following suitable materials, including but not limited to, polyethylene, low density polyethylene (LDPE), linear low density polyethylene (LLDPE), polypropylene, ethyl vinyl acetate (EVA), or other suitable polymeric materials. It is specifically contemplated herein that a combination of EVA, LDPE and LLDPE would provide an advantageous material from which to form the bag. More specifically, it is believed that a combination of about 10% EVA, about 30% LLDPE, and about 60% LDPE provides a bag having the most desirable properties, including pliability, a lower degree of brittleness (particularly at cold temperatures), and the like. Further, although typical bag thickness would be apparent to those of ordinary skill in the art, the preferred bag according to the present invention will have a thickness of about 2.5–3 mils.

Still referring to FIG. 1, each of the first and second panels 12 and 13 extend to and form a bottom or bottom edge 16, side edges 24, 25, an openable top 18, and first and second lips 19 and 22. The panels 12 and 13 are joined or sealed to one another to define a container having an interior or interior region capable of receiving and storing contents.

As contemplated herein, the lips 19 and 22 extend substantially above and from the closure element 30 in a way that facilitates easy opening of the bag 10. To that end, the lips preferably extend more than one inch in height above the closure element 30 (most preferably about two inches in height). During manufacture of the bag 10, the side edges or seals 24, 25 typically extend from the openable top 18 to the bottom 16 and the lips are initially sealed to one another along these side edges. To facilitate opening of the bag 10, a portion of the side edge adjacent the lips 19 and 22 can be notched or otherwise unattached to each other in regions 23, 23*a*. Preferably, at least a portion of the side edges of the lips remains attached to one another immediately above the closure element 30, thereby providing additional strain relief, and the unattached regions 23, 23*a* extend along a majority portion of the side edges of the lips.

Figure 2:
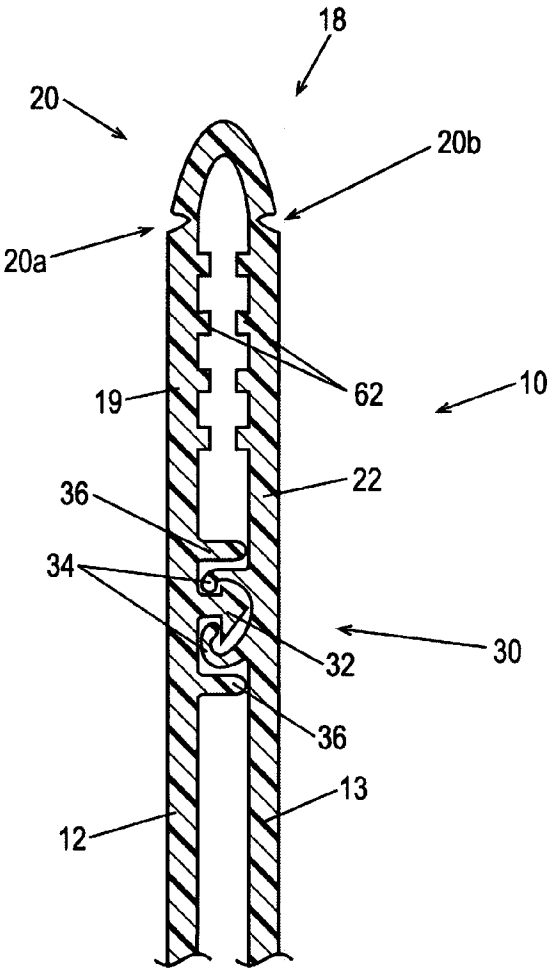
FIG. 2 is a fragmentary cross-sectional view of a portion of the bag of FIG. 1 including a closure element according to one aspect of the present invention.

According to the present invention and as best seen in FIG. 2, a removable element 20 is included which provides evidence of tampering or potential contamination prior to use of the bag 10. When the removable element 20 remains attached to the bag 10, it is indicative that the bag has not yet been used. In other words, in order to actually open the bag, normally the removable element 20 must first be removed. Once the removable element 20 is removed, it is indicative that the bag may have been used. The removable element 20 can be formed by creating an area on the lips 19 and 22 of reduced strength or thickness, such an area being positioned between the openable top 18 and the closure element 30 and shown generally at 20*a* and 20*b*. Exemplary of a method for forming the removable element 20 includes scoring or perforating the lips or otherwise pre-forming the lips to facilitate removal of the removable element. This can include creating a section of reduced thickness relative to the adjacent regions in each of the first and second panels 12 and 13.

The lips can also include gripper lines, such as gripper lines 61 and 62. Although eight such gripper lines are depicted in FIG. 2, those skilled in the art will recognize that fewer or more gripper lines can be employed. Furthermore, the gripper lines can be eliminated altogether. However, the gripper lines are helpful for providing a more sure grasp of the lips for opening of the bag and it is preferred that they be provided.

The openable top 18 communicates with the interior of the bag 10, and provides an avenue by which contents 14 can be placed within or removed from the bag (once the removable element 20 is removed). Once the contents 14 are placed in the bag 10, the bottom 16 spreads using the gusset 17, and the bag is rendered freestanding when filled. Additionally, the lips 19 and 22 are positioned adjacent the openable top 18 and initially joined to one another by the removable element 20.

FIG. 2 illustrates a fragmentary cross-sectional view of a portion of bag 10. According to one aspect of the present invention, the closure element 30 is provided on at least a portion of the at least one panels 12 and 13, and can be, for example, a zip-type closure. The closure element 30 is typically adapted to be releasably engageable, thereby being capable of sealing and unsealing. The closure forms a hermetic seal preventing entry of contaminants into the interior region and/or preventing inadvertent discharge from the interior region. The closure element may be formed on, formed within or attached to the panels. In other words, the closure element can be formed integral with the panel, (such as by extrusion), or separately formed and attached or fused onto the panels after the bag film web is extruded. Such attachment means include but are not limited to adhesive attachment, welding, or other attachment means. In alternative embodiments, the closure can include other types of releasable closures such as releasable adhesive, or even non-releasable closures such as non-releasable adhesive.

A typical closure element 30 is depicted and includes a male element 32 and female element 34, both of which are designed and shaped to be interlocking in such a manner that the bag 10 can be opened from the outside, while resisting opening from the pressures created by the contents of the bag. The male element 32, can further contain one or more structural rib(s) 36 so as to increase the structural integrity and sealing ability of the closure profile. It will likewise be understood that it is within the scope of the present invention that the male element 32 can be attached to the second panel 13 and the female element 34 can be attached to the first panel 12.

Preferably, as shown herein, the male element 32 includes an asymmetrical barb such that the portion of the barb that is oriented towards the contents of the bag 10 is larger (longer) than the portion of the barb oriented away from the contents. Such an arrangement facilitates intentional opening of the lips, while rendering accidental opening (resulting in seepage or spilling of the contents) of the bag less likely.

Figure 3:
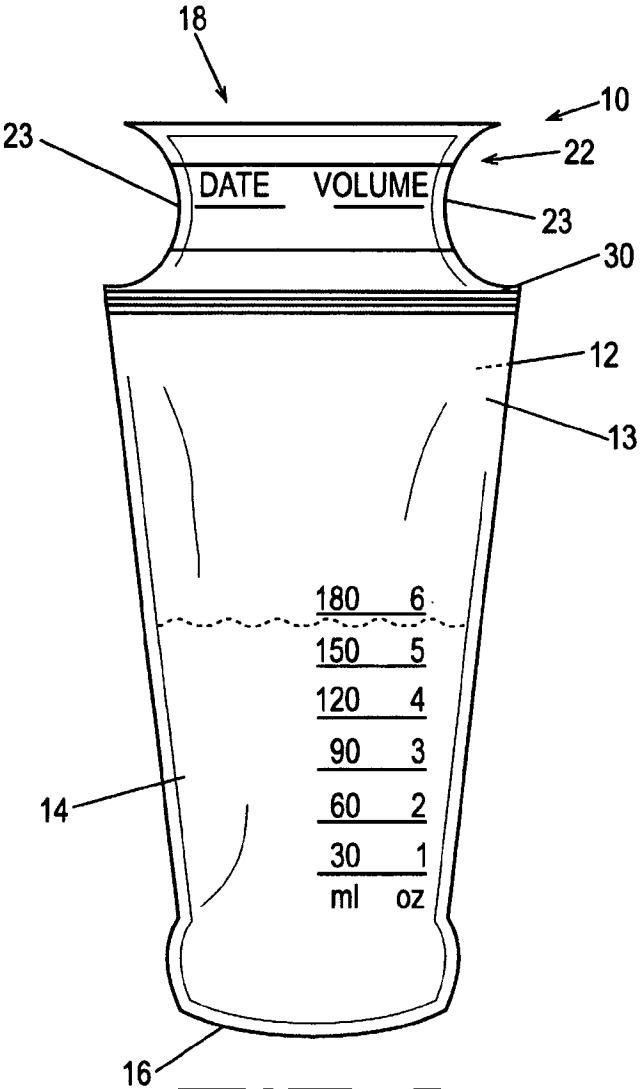
FIG. 3 is a front perspective view of the bag of FIG. 1 shown bearing indicia and containing a liquid according to one aspect of the present invention.
Figure 5:
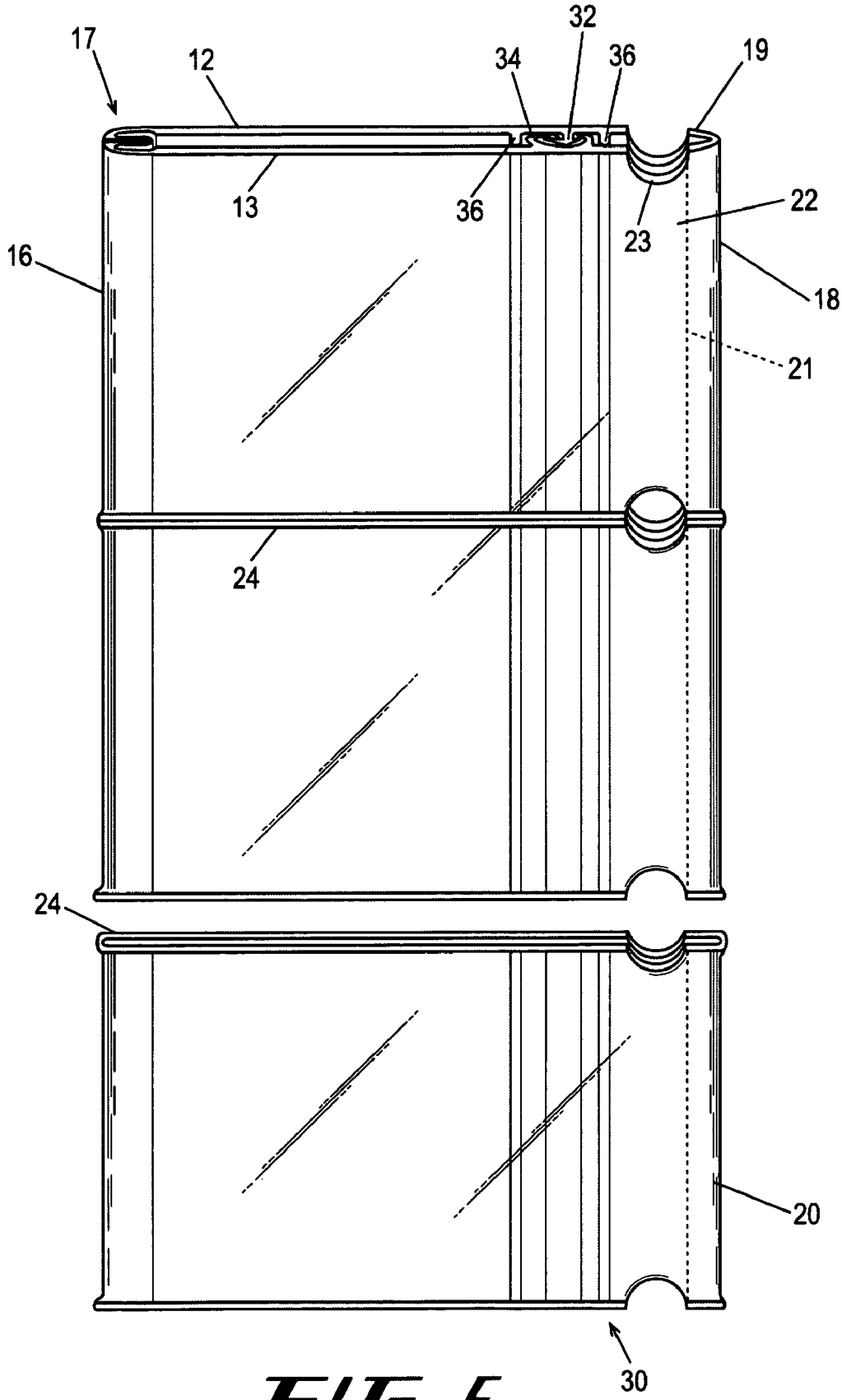
FIG. 5 is a schematic, plan view of bag film as it is being formed into bags according to the present invention.

If desired, various parts of the bag can be formed with strips of different colors. For instance, the male element 32 could be made as a blue strip, while the female element 34 could be made of a red strip. Further, it is also contemplated that any portion of the bag could contain indicia, such as a printed or embossed design. If situated on the lips, the indicia could indicate the location of the removable element 21 (see, for instance, FIG. 4). Provision of indicia of an intricate, regular pattern, such as for example a bulls-eye pattern or cross-hatching, will more readily indicate tampering. As shown in FIG. 3, additional indicia could include quantity markings, identification markings, and the like.

Using an appropriate method for forming reclosable plastic bags, the present invention can be made from a bag film web. The bag 10 can be extruded through a die assembly as a tubular web. It is possible to extrude the web, fold it accordingly, then perform various operations on the folded web to create individual bags. For instance, once the bag film web has been formed into a tube, it can then be rolled onto a spool and fed into an apparatus designed for making bags from bag film web (not shown). One type of a bag making apparatus involves the use of a hot knife that cuts the bag and seals the bag to create the side edges or seals 24, 25 thereby forming a heat seam along the side edges.

To manufacture bags according to the present invention, the following manufacturing steps can be carried out. Firstly, a roll of stock of bag making film (reclosable bag making material) with a specific size and length is chosen (or fabricated). Secondly, a perforation line or scoring is put on the lip of the bag at the time the roll stock is moving on the conveyor of the bag making machine. The lip is not cut completely therethrough and therefore is not separated at this time. Thirdly, a hole punch is used to punch holes in the lips at a predetermined spacing equal to the desired width of the bag. Fourthly, a hot knife is used to cut the bags to length and to heat seal the sides.

Bags according to the present invention have numerous advantages. For example, such a bag is extremely well-suited to containing liquids and aggregate material. Furthermore, it is particularly well-suited to safely storing breast milk, for example. Contributing to this utility is the ability to ensure that the interior of the bag has not been contaminated simply by observing that the tamper-evident strip or removable element is still attached to the lips (i.e., the lips are still attached to one another). This is a good indication that the bag has not been opened and thereby indicates that no contamination has been introduced into the interior of the bag. Moreover, the large lips provide more convenient handles for handling the bag and opening the openable top of the bag. The cutouts in the lips provide a ready grip even when the lips are still joined by the removable strip. Furthermore, by eliminating some of the heat seal normally found on typical prior art reclosable plastic bags along the entire length of the side edges of the lips, the lips are more naturally opened, ready to pull part.

Also, by retaining some heat seal along the side edges of the lips immediately above the closure element, the integrity of the edge of the closure element is protected as the user pulls on the lips. In other words, with at least a little heat seal above the closure element, the closure element is protected from pulling on the lips otherwise would tend to pull the edges of the closure element apart.

Figure 4:
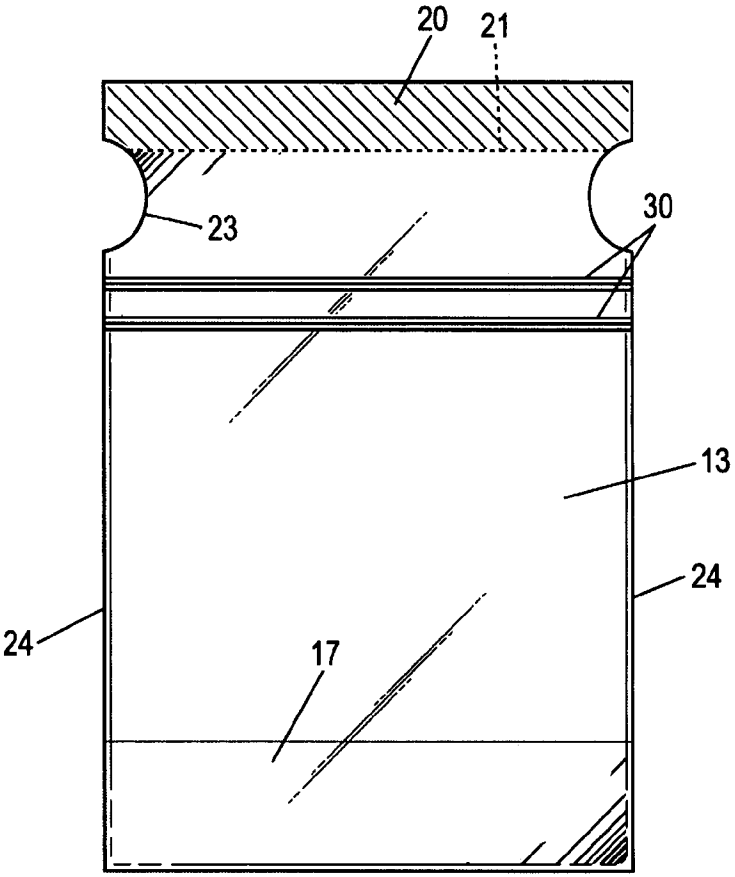
FIG. 4 is a front view of a tamper evident reclosable plastic bag according to a second preferred form of the invention, the bag including multiple closure elements.

As shown in FIG. 4, it is also possible according to the present invention that more than one closure element 30 can be utilized to ensure that contents of the bag are not lost. As shown herein, primary and secondary closure elements 30 are arranged and oriented parallel to one another, separated by a gap of about ¼ inch or so. Using such an arrangement, if one closure element fails, the secondary closure element can yet contain the contents.

In use, the removable element 20 is detached from the lips 19 and 22 of the bag 10. The lips are then separated, and the closure element 30 is opened to deposit contents 14 (e.g., breast milk) into the interior region of the bag 10 through the openable top 18. Additional contents can be deposited, or deposited contents can be removed from the interior region by selectively opening and resealing the first and second closure element 30.

If a small ultrasonic seal is applied to the ends of the closure 30, this tends to flatten out the high profile of the closure (the bumpiness of the profile). This facilitates the use of a substantially wider side heat seam along the side edges of the bag, which can be advantageous for providing a more leak-proof bag. The small ultrasonic seal typically would be on the order of ⅛ inch or less across.

The terms and expressions which have been employed herein are used as terms of description and not of limitation, and there is no intention, in the use of such terms and expressions, of excluding any equivalents of the features shown and described or portions thereof. Having thus described the invention in detail, it should be apparent to those skilled in the art that various modifications can be made in the present invention without departing from the spirit and scope of the following claims.

The invention claimed is:

1. A reclosable plastic bag, comprising:

A. a first panel attached to a second panel to form a container having a bottom and a sealed top edge;

B. a primary closure located between the bottom and the sealed top edge, comprising:

i. a primary female profile on the first panel of the container, ii. a primary male profile on the second panel of the container that is configured to engage selectively with the primary female profile;

C. a removable element of the container extending from the sealed top edge to a separation line located between the sealed top edge and the primary closure and that when still attached to the container indicates that the container has not yet been opened;

D. a first lip portion of the first panel extending from the primary closure to the separation line and including a first right edge and a first left edge; and E. a second lip portion of the second panel extending from the primary closure to the separation line and including a second right edge and a second left edge; in which:

i. the first right edge is attached to the second right edge from the primary closure to a right cutout portion of the first and second lip portions in which the first right edge is not attached to the second right edge and ii. the first left edge is attached to the second left edge from the primary closure to a left cutout portion of the first and second lip portions in which the first left edge is not attached to the second left edge.

2. The reclosable plastic bag of claim 1 further comprising a secondary closure located between the bottom and the primary closure, comprising:

A. a secondary female profile on the first panel of the container,

B. a secondary male profile on the second panel of the container that is configured to engage selectively with the secondary female profile.

3. The reclosable plastic bag of claim 1 in which the primary male profile further comprises an asymmetrical barb oriented in a direction to facilitate disengaging the primary male from the primary female profile by pulling the first lip portion away from the second lip portion.

4. The reclosable plastic bag of claim 3 further comprising a secondary closure located between the bottom and the primary closure, comprising:

A. a secondary female profile on the first panel of the container,

B. a secondary male profile on the second panel of the container that is configured to engage selectively with the secondary female profile.

5. The reclosable plastic bag of claim 1 in which the first lip portion and the second lip portion are scored, perforated, or otherwise pre-formed along the separation line to facilitate removing the removable element.

* * * * *